United States Patent [19]

Miyagi et al.

[11] 4,387,682

[45] Jun. 14, 1983

[54] METHOD AND APPARATUS FOR CONTROLLING THE AIR INTAKE OF AN INTERNAL COMBUSTION ENGINE

[75] Inventors: Hideo Miyagi, Okazaki; Masaomi Nagase, Toyota, both of Japan

[73] Assignee: Toyota Jidosha Kogyo Kabushiki Kaisha, Toyota, Japan

[21] Appl. No.: 304,872

[22] Filed: Sep. 23, 1981

[30] Foreign Application Priority Data

Sep. 26, 1980 [JP] Japan ..... 55-133010

[51] Int. Cl.[3] ..... F02D 9/00

[52] U.S. Cl. ..... 123/339; 123/585; 123/179 B

[58] Field of Search ..... 123/588,585, 339, 340, 123/362, 179 BG, 179 B

[56] References Cited

U.S. PATENT DOCUMENTS

| | | | |
|---|---|---|---|
| 3,661,131 | 5/1972 | Croft . | |
| 3,964,457 | 6/1976 | Coscia . | |
| 3,977,380 | 8/1976 | Atsumi et al. | 123/588 X |
| 4,240,145 | 12/1980 | Yano et al. | 123/585 X |

FOREIGN PATENT DOCUMENTS

| | | | |
|---|---|---|---|
| 55-60636 | 5/1980 | Japan | 123/585 |
| 55-48933 | 11/1980 | Japan | 123/585 |

*Primary Examiner*—William A. Cuchlinski, Jr.
*Attorney, Agent, or Firm*—Cushman, Darby & Cushman

[57] ABSTRACT

The sectional area of an air bypass passage which bypasses a throttle valve in an intake passage of an internal combustion engine is increased or decreased depending upon the difference between the actual rotational speed of the engine and the variable reference rotational speed. The variable reference rotational speed is additionally increased by an incremental value during the starting of the engine.

14 Claims, 5 Drawing Figures

METHOD AND APPARATUS FOR CONTROLLING THE AIR INTAKE OF AN INTERNAL COMBUSTION ENGINE

BACKGROUND OF THE INVENTION

The present invention relates to a method of and apparatus for, controlling the flow rate of air intake of an internal combustion engine, particularly as it relates to an air intake control method during the idling condition.

There is known a method of controlling the air intake of an internal combustion engine when a throttle valve disposed in an intake passage is at the fully closed position. According to this conventional method, the flow rate of intake air, when the throttle valve is fully closed, is controlled by adjusting the bypassed section of a flow passage by means of a control valve disposed in an air bypass passage which communicates the intake passage at a position located upstream of the throttle valve with the intake passage at a position located downstream of the throttle valve. Such an air intake control method is usually employed for controlling the idling rotational speed of the engine. The idling rotational speed can be controlled by a closed loop if the bypass control valve is adjusted to control the flow rate of the air sucked into the engine through the bypass passage so that the detected actual rotational speed of the engine becomes equal to the reference rotational speed which corresponds to a desired idling rotational speed.

According to the conventional intake air control method, the reference rotational speed is predetermined by a desired rotational speed which is changed depending upon the warmed up condition of the engine and upon the load condition of the engine but is not changed depending upon whether the engine is in the starting condition or not. Therefore, according to the conventional method, the following problems often occur.

(1) The reference rotational speed becomes quite the same value when the temperature of the engine which is started from cold reaches, for example, 60° C. and when the engine which has been completely warmed up is temporarily stalled and is soon re-started again while the temperature is 60° C. In the latter case, in general, there is no need to set the reference rotational speed high, but the reference rotational speed should rather be set low to reduce the consumption of fuel. In the former case, on the other hand, the reference rotational speed should be set high to improve the starting performance and the operation feeling when the engine is being started. Therefore, if the reference rotational speed is set so as to satisfy the latter operation, the actual rotational speed becomes too low and the operation feeling is deteriorated during the former operation. Further, if the reference rotational speed is set so as to satisfy the former operation, the actual rotational speed becomes too high, the operation feeling is deteriorated, and fuel is consumed in large amounts during the latter operation.

(2) Immediately after starting, the actual rotational speed of the engine generally rises quickly. If the reference rotational speed is controlled in an ordinary manner under such a condition, the control system is excessively corrected, and the actual rotational speed after ones controlled develops overshooting and hunting.

SUMMARY OF THE INVENTION

It is, therefore, an object of the present invention to provide a method and apparatus for controlling the air intake of an internal combustion engine, whereby the operational feeling of the engine during starting and immediately after starting can be greatly improved.

According to the present invention, a method of, and apparatus for controlling the air intake of an internal combustion engine comprises detecting the actual rotational speed of the engine to produce a rotational speed signal which represents the detected rotational speed. The operating condition and/or the load condition of the engine is detected to produce at least one engine condition signal which represents the detected operating condition and/or the detected load condition. In response to said at least one engine condition signal, a reference rotational speed is determined which corresponds to a desired rotational speed in the detected operating condition and/or the detected load condition. By using the produced rotational speed signal and the determined reference rotational speed, the difference between the actual rotational speed of the engine and the reference rotational speed is calculated to produce a control output signal which is determined depending upon the calculated difference. Whether the engine is in the starting condition or not is detected to produce a starting condition signal. In response to the starting condition signal, when the engine is in the starting condition, the reference rotational speed is increased from the determined reference rotational speed by an increment value. In response to the starting condition signal, when the engine is in the starting condition, by using the produced rotational speed signal and a signal indicative of the increased reference rotational speed, the difference between the actual rotational speed of the engine and the increased reference rotational speed is calculated to produce a control output signal which is determined depending upon the calculated difference. In response to the control output signal, the sectional area of an air bypass passage which bypasses the throttle valve is adjusted to control the flow rate of air passing through the air bypass passage so as to reduce the difference between the actual rotational speed and the reference rotational speed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
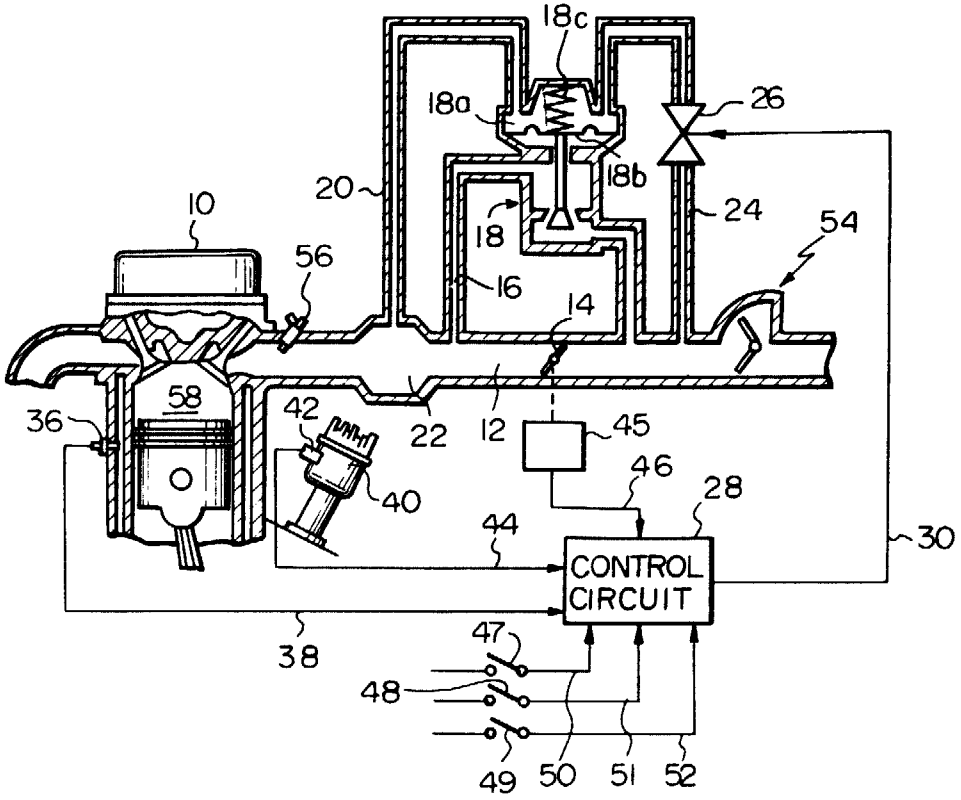
FIG. 1 is a schematic diagram illustrating a system in which the method of the present invention is used.

Referring to FIG. 1, in which an example of an electronic fuel injection control system of an internal combustion engine according to the method of the present invention is illustrated, a reference numeral 10 denotes an engine body, and 12 denotes an intake passage. A throttle valve 14 is disposed in the intake passage 12.

An air control valve (ACV) 18 is provided in an air bypass passage 16 which communicates the upstream side of the throttle valve 14 in the intake passage 12 with the downstream side of the throttle valve 14 in the intake passage 12. The ACV 18 operates in response to a vacuum pressure which is applied to a diaphragm chamber 18*a*, and controls the flow rate of air which passes through the air bypass passage 16. Namely, as the vacuum pressure increases in the diaphragm chamber 18*a*, a diaphragm 18*b* is pulled against a spring 18*c*, and the cross-sectional area of the flow passage is reduced to decrease the flow rate of the bypass air. Contrary to this, as the vacuum pressure decreases in the diaphragm chamber 18*a*, the diaphragm 18*b* is pushed by the spring 18*c*, whereby the cross-sectional area of the flow passage is increased to increase the bypass air flow rate.

The diaphragm chamber 18*a* of the ACV 18 is communicated, via a conduit 20, with a surge tank 22 which is located on the downstream side of the throttle valve 14, and is further communicated with the intake passage 12 on the upstream side of the throttle valve 14 via a conduit 24. A vacuum pressure switching valve (VSV) 26 is disposed in the conduit 24. The VSV 26 is operated by electrical signals that are sent from a control circuit 28 via a line 30 to control the vacuum pressure in the diaphragm chamber 18*a* of the ACV 18. Namely, as the VSV 26 is energized by an electrical current, the path opens so that the air is permitted to flow into the diaphragm chamber 18*a* to decrease the vaccum pressure.

A coolant temperature sensor 36 is disposed in the cylinder block of the engine to detect the temperature of the coolant, and an analog voltage which represents the detected coolant temperature is sent to the control circuit 28 via a line 38.

A distributor 40 is provided with a crank angle sensor 42 which produces a pulse at every predetermined angle rotation, for example, every time the crank shaft turns by 30°CA. The produced pulses are sent to the control circuit 28 via a line 44.

A throttle position sensor 45 is attached to the rotary shaft of the throttle valve 14 to detect if the throttle valve 14 is at the idling position (fully closed position). The electrical signal, which represents the detected result, is fed to the control circuit 28 via a line 46.

The control circuit 28 further receives a signal, via a line 50, from a starter switch 47, which is turned on when the engine is in the starting condition, a signal, via a line 51, from a neutral switch 48, which is turned on when an automatic transmission is shifted in neutral, and a sigal, via a line 52, from an air conditioner actuating switch 49, which is turned on when an air conditioner is operated.

In electronic fuel injection control type internal combustion engines of this kind, as is well known, the flow rate of the air sucked into the engine is detected by an air flow sensor 54. Fuel, in an amount which corresponds to the detected flow rate of the intake air, is injected from a fuel injection valve 56 to produce the gas mixture which is fed to a combustion chamber 58. Therefore, if the flow rate of the bypass air through the air bypass passage 16 is controlled by the ACV 18 when the throttle valve 14 is at the idling position, the idling rotational speed of the engine is controlled depending upon the bypass air flow rate.

Figure 2:
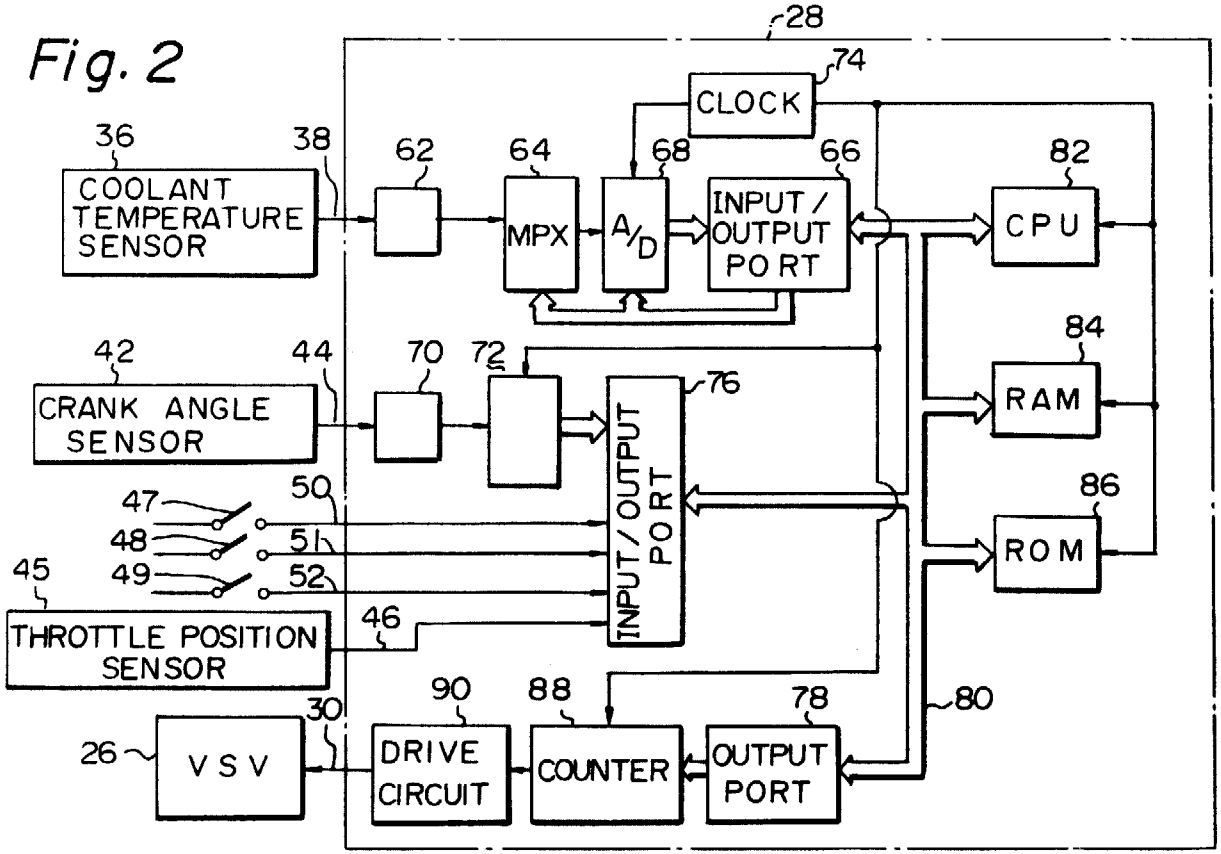
FIG. 2 is a block diagram illustrating a control circuit in the system of FIG. 1.

FIG. 2 is a block diagram which illustrates in detail the control circuit 28 of FIG. 1.

Voltage signals from the coolant temperature sensor 36 via a buffer 62 and from other non-diagrammed sensors are fed to an analog multiplexer 64, and then fed to an A/D converter 68 in sequence responsive to selection signals form an input/output port 66. In the A/D converter 68, the voltage signals are converted into signals in the form of a binary number. The converted binary signals are fed to the input/output port 66.

A pulse produced by the crank angle sensor 42 at every crank angle of 30° is fed to a speed signal-forming circuit 72 via a buffer 70. The speed signal-forming circuit 72 consists of a gate that is opened and closed by a pulse produced at every crank angle of 30°, and a counter which counts the number of clock pulses applied to the counter from a clock generator circuit 74 via the gate. The speed signal-forming circuit 72 forms speed signals in the form of a binary number which signals represent the actual rotational speed of the engine. The formed binary speed signals are applied to a predetermined bit position of an input/output port 76.

Signals from the throttle position sensor 45, the starter switch 47, the neutral switch 48 and the air conditioner actuating switch 49 are applied to predetermined bit positions of the input/output port 76.

The input/output ports 66, 76, and an output port 78, which will be mentioned later, are connected via a bus 80, to a central processing unit (CPU) 82, a random access memory (RAM) 84, and a read-only memory (ROM) 86, which are major components constituting a microcomputer. The RAM 84 temporarily stores a variety of input data, the data used in the arithmetic calculation, and the results of the arithmetic calculations. In the ROM 86 have been stored beforehand a program for processing the arithmetic calculations that will be mentioned later, and a variety of data necessary for processing the arithmetic calculations.

A binary control output $D_{out}$ for controlling the VSV 26 is fed from the CPU 82 to the output port 78, and then is set in a presettable down counter 88. The down counter 88 starts to count down the operation with respect to the set content at every predetermined period of time, for example, at every 50 msec. Namely, the down counter 88 reduces the set content one by one to zero, in response to the clock pulses from the clock generator circuit 74. Thus, the output of the high level is fed to a drive circuit 90 during the count down operation. The drive circuit 90 energizes the VSV 26 as long at it is served with the output of the high level. Therefore, the VSV 26 is energized at a duty ratio which corresponds to the control output $D_{out}$. Consequently, the bypass air flow rate is controlled depending upon the control output $D_{out}$.

Figure 3:
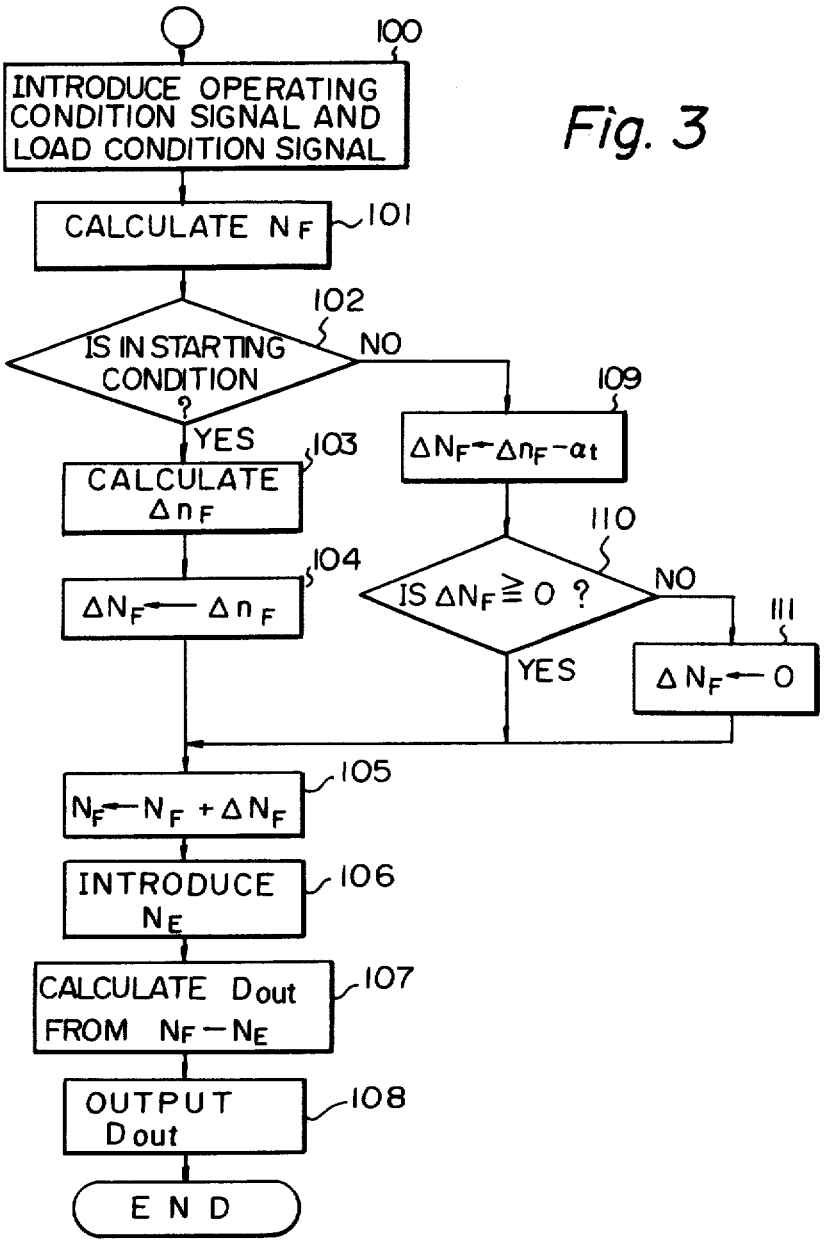
FIG. 3 is a flow diagram illustrating the operations of the digital computer in the control circuit of FIG. 2.

Below is illustrated the content of an arithmetic calculation executed by the microcomputer. After the ignition switch is turned on and the initializing operation is carried out, the CPU 82 executes a processing routine, as partly illustrated in FIG. 3, at every predetermined period of time.

At a point 100, the CPU 82 introduces the operating condition signal and the load condition signal from the RAM 84. These signals consist of the detection data with respect to the coolant temperature THW, the throttle position signal from the throttle position sensor 45, and the signals from the starter switch 47, the neutral switch 48 and the air conditioner actuating switch 49, which have been previously input and stored in the RAM 84. Then, at a point 101, the reference rotational speed $N_F$ is calculated depending upon the introduced operating condition signal and the introduced load condition signal by using, for example, the following equation.

$$N_F = A \cdot f(THW) + B$$

where A and B are variable values determined in accordance with the intake air temperature THA, the throttle position, whether the shift position of the automatic transmission is the neutral range or the drive range, and whether the air conditioner is being operated or not. Furthermore, f(THW) is a temperature coefficient depending upon the coolant temperature THW. The coefficient f(THW) increases if the coolant temperature THW decreases, and vice versa. The coefficient f(THW), however, is maintained at 1.0 when the coolant temperature THW is higher than or equal to 80° C.

At a point 102, then, the CPU 82 discriminates whether the engine is in the starting condition or not, relying upon a signal from the starter switch 47. When the engine is in the starting condition, the program proceeds to a point 103 where an incremental value for increasing the reference rotational speed $N_F$ during starting (starting inceremental value) is calculated. This starting incremental value $\Delta n_F$ may be calculated from a function of the operating conditions such as the coolant temperature THW and of the load conditions, or may be calculated from a predetermined rate relative to the reference rotational speed $N_F$ which is calculated at the point 101, or may be simply given as a predetermined fixed value. Then, at a point 104, the calculated starting incremental value $\Delta n_F$ is set to an incremental value $\Delta N_F$. Namely, the operation of $\Delta N_F \leftarrow \Delta n_F$ is executed at the point 104. At a next point 105, the incremental value $\Delta N_F$ is added to the reference rotational speed $N_F$ calculated at the point 101, i.e., the calculation of $N_F \leftarrow N_F \leftarrow \Delta N_F$ is performed.

Then, at a point 106, the CPU 82 introduces from the RAM 84 a detection datum related to the actual rotational speed $N_E$ of the engine, and at a point 107, calculates the control output $D_{out}$ based upon the difference between the introduced actual rotational speed $N_E$ and the calculated reference rotational speed $N_F$. The calculation at the point 107 can be performed according to one of the following two methods. One method is to find the control output $D_{out}$ according to the relation, $$D_{out} = D'_{out} + C \cdot (N_F - N_E)$$

where $D'_{out}$ denotes a control output in the previous calculation cycle and C denotes a constant. Another method is to find the control output $D_{out}$ employing a predetermined reference value $D_O$ according to the relation, $$D_{out} = D_0 + E \cdot (N_F - N_E)$$

where D denotes a constant.

In the point 107 as mentioned above, the control output $D_{out}$ is increased or decreased responsive to the difference $N_F - N_E$. If it is required, at the point 107, the CPU 82 corrects the calculated control output $D_{out}$ to be additionally increased or decreased, depending upon the operating condition of the engine and upon the load condition of the engine. Then, at a point 108, the calculated control output $D_{out}$ is fed to the output port 78 shown in FIG. 2.

According to the above-mentioned arithmetic processing, the reference rotational speed $N_F$ is increased by $\Delta n_F$ when the engine is in the starting condition, whereby the rise of the actual rotational speed is improved when the engine is being started, and the feeling of starting the engine is greatly improved.

When it is discriminated at the point 102 that the engine is not in the starting condition, the program proceeds to a point 109 where an increment value $\Delta N_F$ that is smaller by $\alpha t$ than the starting increment value $\Delta n_F$ is produced. Namely, at the point 109, the CPU 82 executes the calculation of $\Delta N_F \leftarrow \Delta n_F - \alpha t$, where $\Delta$ is a constant, and t represents a variable value which corresponds to the lapse of time from the moment at which the starting operation of the engine is finished, or represents a variable value that corresponds to the number of rotations of the engine from the moment at which the starting operation is finished. The variable value t of this type can be easily obtained from the output of a timer which commences the counting operation from the moment at which the starter switch 47 is turned off, or can be obtained from the output of a counter which commences to count the pulses that are produced every rotation of the crank shaft from the moment at which the starter switch 47 is turned off. Then, the program proceeds to a point 110 where it is discriminated whether the incremental value $\Delta N_F$ calculated at the point 109 is greater than zero or not. When $\Delta N_F \geqq 0$, the program proceeds to the point 105. When $\Delta N_F < 0$, the operation $\Delta N_F \leftarrow 0$ is executed at a point 111, and the program proceeds to the point 105. The contents processed in the points 105 to 108 are as mentioned in the foregoing.

According to the above-mentioned processing, the incremental value $\Delta N_F$ for additionally increasing the reference rotational speed $N_F$ after starting gradually decreases from $\Delta n_F$ in response to the lapse of time after starting, or the incremental value $\Delta N_F$ decreases in response to the number of rotations of the crank shaft after starting. The incremental value $\Delta N_F$ finally approaches zero. Consequently, the reference rotational speed $N_F$ is increased only for a while after the starting operation has been finished. Therefore, the controlled rotational speed is increased, and the feeling when the engine is being started is greatly improved. Further, since the reference rotational speed $N_F$ is increased during and immediately after starting, and then the incremental value $\Delta N_F$ gradually decreases after starting, the control output $D_{out}$ is not rapidly increased, and excess of correction is not effected. Accordingly, the actual rotational speed can be smoothly controlled, and the overshooting or hunting in the rotational speed after being controlled can be greatly suppressed.

Figure 4A:
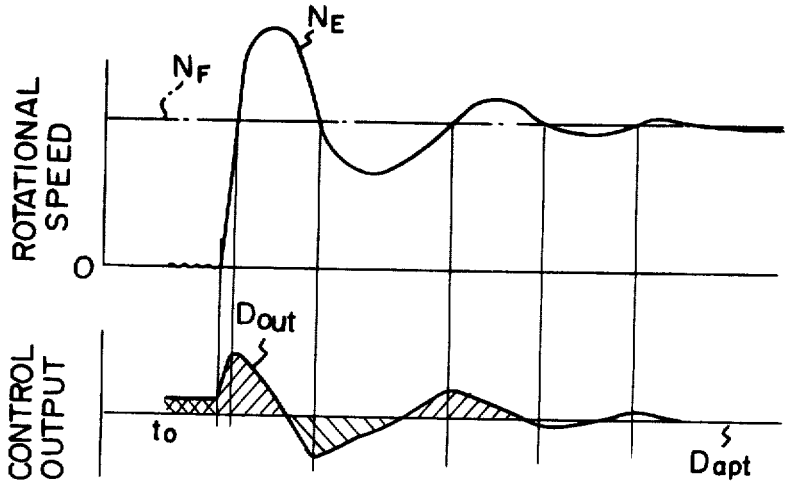
Fig. 4a PRIOR ART
FIGS. 4*a* and 4*b* contain waveforms for illustrating operations according to the prior art and according to the programs shown in FIG. 3, respectively.
Figure 4B:
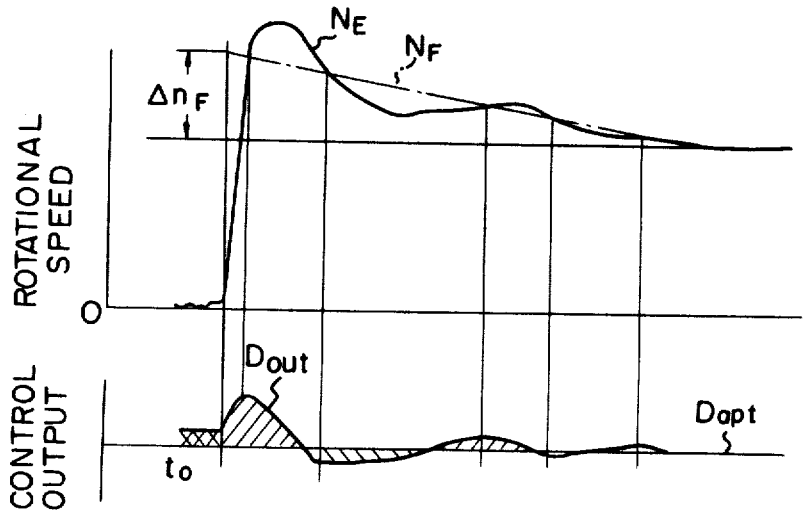

FIGS. 4a and 4b are diagrams for explaining the functions and effects of the prior art and the present invention. FIG. 4a illustrates the reference rotational speed $N_F$, actual rotational speed $N_E$ and a change in the control output $D_{out}$ according to a conventional method. FIG. 4b illustrates the reference rotational speed $N_F$, actual rotational speed $N_E$ and a change in the control output $D_{out}$. According to the conventional method as shown in FIG. 4a, the reference rotational speed $N_F$ at the time $t_o$ when the engine is being started is the same as in the ordinary operating condition. Therefore, the actual rotational speed $N_E$ is not increased even when the engine is being started, and the engine, when it is being started, does not give a comfortable feeling. Further, since the difference is great between the reference rotational speed $N_F$ and the actual rotational speed $N_E$ during and immediately after starting, the control output $D_{out}$ undergoes great variation relative to an optimum control value $D_{apt}$ and excessive correction occurs. Therefore, the rotational speed undergoes overshooting or hunting for a while after the engine has been started, and does not give such a comfortable operational feeling. According to the processing routine of FIG. 3, on the other hand, the reference rotational speed $N_F$ is increased by $\Delta n_F$ when the engine is being started as illustrated in FIG. 4*b*. When the engine is being started, therefore, the rotational speed rises well, and the feeling when the engine is being started is greatly improved. Further, even after the engine has been started, the reference rotational speed is increased as compared with the reference rotational speed in the ordinary condition, and the increment is gradually decreased. Therefore, the difference between $N_F$ and $N_E$ is maintained minimal at all times, the control output $D_{out}$ does not greatly vary relative to the optimum control value $D_{apt}$, and the actual rotational speed changes smoothly without developing overshooting or hunting. Consequently, the driving feeling during and immediately after starting can be greatly improved.

According to the present invention as illustrated in detail in the foregoing, the reference rotational speed is additionally increased when the engine is being started and, hence, the actual rotational speed rises well. Further, the feedback control can be effected very smoothly, and the operational feeling can be markedly improved during and immediately after starting.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling the air intake of an internal combustion engine having an intake passage, a throttle valve disposed in the intake passage, and an air bypass passage which communicates the intake passage at a position located upstream of the throttle valve with the intake passage at a position located downstream of the throttle valve, said method comprising the steps of:

detecting the actual rotational speed of the engine to produce a rotational speed signal which represents the detected rotational speed;

detecting at least one of the operating conditions and the load condition of the engine to produce at least one engine condition signal which represents at least one of the detected operating condition and the detected load condition;

determining, in response to said at least one engine condition signal, a reference rotational speed which corresponds to a desired rotational speed for at least one of the detected operating condition and the detected load condition;

calculating, by using the detected rotational speed signal and a signal indicative of the determined reference rotational speed, the difference between the actual rotational speed of the engine and the reference rotational speed to produce a control output signal which is determined by the calculated difference;

detecting whether the engine is in the starting condition to produce a starting condition signal;

increasing, in response to the starting condition signal, when the engine is in the starting condition, the reference rotational speed from said determined reference rotational speed by an incremental value;

calculating, in response to the starting condition signal, when the engine is in the starting condition, by using the detected rotational speed signal and a signal indicative of the increased reference rotational speed, the difference between the actual rotational speed of the engine and the increased reference rotational speed to produce a control output signal which is determined by the calculated difference; and adjusting, in response to the control output signal, the sectional area of the air bypass passge to control the flow rate of air passing through the air bypass passage so as to reduce the difference between the actual rotational speed and the reference rotational speed.

2. A method as claimed in claim 1, wherein said method further comprises steps of:

detecting whether a predetermined period has passed after starting, to produce an after starting condition signal;

increasing, in response to the after starting condition signal, when the predetermined period has not passed after starting, said determined reference rotational speed; and calculating, in response to the after starting condition signal, when the predetermined period has not passed after starting, when the predetermined period has not passed after starting, the difference between the actual rotational speed of the engine and the increased reference rotational speed to produce a control output signal which is determined by the calculated difference, by using the detected rotational speed signal and the increased reference rotational speed.

3. A method as claimed in claim 1, wherein said method further comprises a step of slowly decreasing, in response to the lapse of time after starting, the incremental value which is used for increasing the reference rotational speed during starting, after the engine starts.

4. A method as claimed in claim 1, wherein said method further comprises a step of slowly decreasing, in response to the number of rotations of the engine after starting, the incremental value which is used for increasing the reference rotational speed during starting, after the engine starts.

5. A method as claimed in claim 1, 3 or 4, wherein said incremental value is a predetermined fixed value.

6. A method as claimed in claim 1, 3 or 4, wherein said incremental value is a variable value determined by at least one of the detected operating condition and the detected load condition.

7. A method as claimed in claim 1, 3 or 4, wherein said incremental value is a variable value determined by said determined reference rotational speed.

8. An apparatus for controlling the air intake of an internal combustion engine having an intake passage, a throttle valve disposed in the intake passage, and an air bypass passage which communicates the intake passage at a position located upstream of the throttle valve with the intake passage at a position located downstream of the throttle valve, said apparatus comprising:

means for detecting the actual rotational speed of the engine to produce a rotational speed signal which represents the detected rotational speed;

means for detecting at least one of the operating condition and the load condition of the engine to produce at least one engine condition signal which represents at least one of the detected operating condition and the detected load condition;

means for determining, in response to said at least one engine condition signal, a reference rotational speed which corresponds to a desired rotational speed for at least one of the detected operating condition and the detected load condition;

means for calculating, by using the detected rotational speed signal and a signal indicative of the determined reference rotational speed, the difference between the actual rotational speed of the engine and the reference rotational speed to produce a control output signal which is determined by the calculated difference;

means for detecting whether the engine is in the starting condition to produce a starting condition signal;

means for increasing, in response to the starting condition signal, when the engine is in the starting condition, the reference rotational speed from said determined reference rotational speed by an incremental value;

said means for calculating, in response to the starting condition signal, when the engine is in the starting condition, by using the detected rotational speed signal and a signal indicative of the increased reference rotational speed, calculating the difference betwen the actual rotational speed of the engine and the increased reference rotational speed to produce a control output signal which is determined by the calculated difference, and means for adjusting, in response to the control output signal, the sectional area of the air bypass passage to control the flow rate of air passing through the air bypass passage so as to reduce the difference between the actual rotational speed and the reference rotational speed.

9. An apparatus as claimed in claim 8, wherein said apparatus further comprises:

means for detecting whether a predetermined period has passed after starting, to produce an after starting condition signal;

and wherein said means for increasing increases, in response to the after starting condition signal, when the predetermined period has not passed after starting, said determined reference rotational speed; and wherein the means for calculating calculates, in response to the after starting condition signal, when the predetermined period has not passed after starting, the difference between the actual rotational speed of the engine and the increased reference rotational speed to produce a control output signal which is determined by the calculated difference, by using the detected rotational speed signal and the increased reference rotational speed.

10. An apparatus as claimed in claim 8, wherein said apparatus further comprises means for slowly decreasing, in response to the lapse of time starting, the incremental value which is used for increasing the reference rotational speed during starting, after the engine starts.

11. An apparatus as claimed in claim 8, including means for measuring the number of rotations of the engine after starting, and wherein said apparatus further comprises means for slowly decreasing, in response to the number of rotations of the engine after starting, the incremental value which is used for increasing the reference rotational speed during starting, after the engine starts.

12. An apparatus as claimed in claim 8, 10 or 11, wherein said incremental value is a predetermined fixed value.

13. An apparatus as claimed in claim 8, 10 or 11, wherein said incremental value is a variable value determined by one of the detected operating condition and the detected load condition.

14. An apparatus as claimed in claim 8, 10 or 11, wherein said incremental value is a variable value determined by said determined reference rotational speed.

* * * * *